US005927615A

United States Patent [19]

Turk

[11] Patent Number: 5,927,615

[45] Date of Patent: Jul. 27, 1999

[54] STEAM OUTLET ASSEMBLY

[75] Inventor: Robin P. Turk, Kent, United Kingdom

[73] Assignee: Eaton-Williams Group Limited, Edenbridge, United Kingdom

[21] Appl. No.: 08/908,431

[22] Filed: Aug. 7, 1997

[30] Foreign Application Priority Data

Aug. 8, 1996 [GB] United Kingdom ..... 9616678

[51] Int. Cl.[6] ..... B05B 1/00

[52] U.S. Cl. ..... 239/590.3; 239/550; 239/566; 239/600; 261/118; 261/DIG. 76; 285/191; 285/192

[58] Field of Search ..... 239/547, 550, 239/553, 553.3, 554, 566, 590.3, 600, DIG. 4; 261/118, DIG. 76; 285/191, 192

[56] References Cited

U.S. PATENT DOCUMENTS

| | | | |
|---|---|---|---|
| 2,605,140 | 7/1952 | Bartling | 239/550 X |
| 3,269,664 | 8/1966 | Lamb et al. | 239/547 X |
| 3,563,471 | 2/1971 | Watkin | 239/550 X |
| 4,349,073 | 9/1982 | Zublin | 239/550 X |
| 4,527,745 | 7/1985 | Butterfield et al. | 239/590.3 X |
| 5,072,710 | 12/1991 | Washizu | 239/550 X |
| 5,277,849 | 1/1994 | Morton et al. | 261/118 |
| 5,376,312 | 12/1994 | Morton et al. | 261/DIG. 76 X |

FOREIGN PATENT DOCUMENTS

| | | | |
|---|---|---|---|
| 3628724 | 2/1988 | Germany | 239/550 |

*Primary Examiner*—Andres Kashinikau
*Assistant Examiner*—Steven J. Ganey
*Attorney, Agent, or Firm*—Dickinson Wright PLLC

[57] ABSTRACT

A steam outlet assembly comprises a metal tubular portion within which steam passes when the assembly is in use. A plastics steam nozzle extends through apertures in the tubular portion which are spaced apart circumferentially therearound. The plastics nozzle is provided with a transverse through-bore in the tubular portion interior opening out at a head end and/or a screw-threaded end of the nozzle, outside the tubular portion. The nozzle is provided with seals means around apertures on the outside of the tubular portion.

4 Claims, 7 Drawing Sheets

FIG. 3a
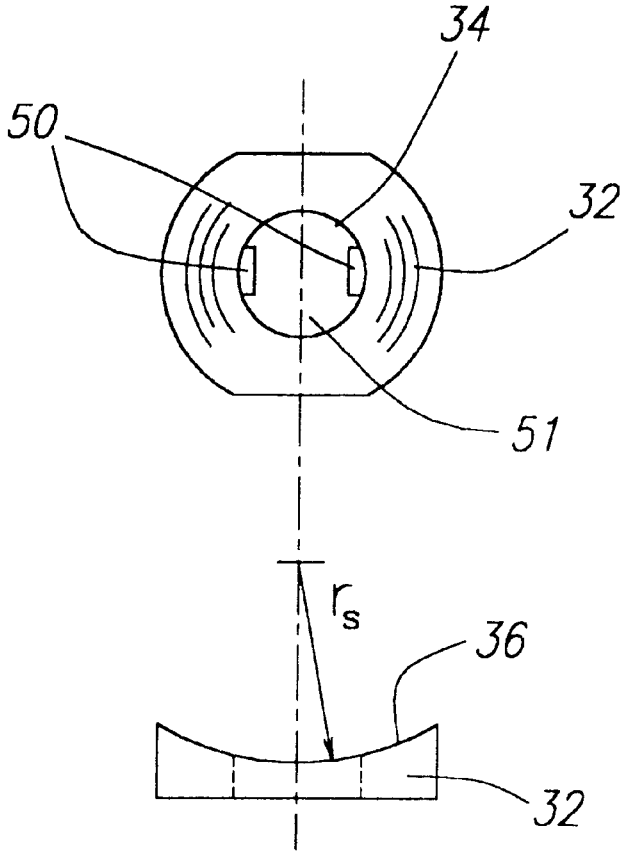
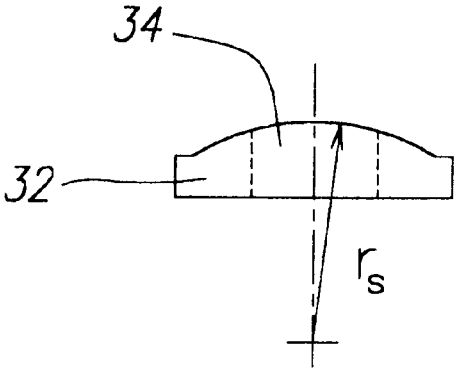
FIG. 3b
FIG. 3c

Section IV-IV

Section V-V

STEAM OUTLET ASSEMBLY

The present invention relates to a steam outlet assembly, especially but not exclusively for injecting steam into air-conditioning ducting, to humidify the air provided by the air-conditioning.

Hitherto, such an outlet assembly has comprised a pipe through which steam is fed when the assembly is in use, and a plastics nozzle having a head which rests against the outer wall of the pipe, and a shank which extends through an aperture in the pipe, the shank being provided with resilient latch portions which engage the internal wall of the pipe, the nozzle having a through-bore extending axially through its centre, whereby steam can pass from the interior of the pipe to the exterior thereof.

A disadvantage of this construction of a steam outlet assembly is that the resilient latch portions which are used to hold the nozzle in place may break off and fall inside the steam pipe and subsequently lead to blockages.

In another previously proposed construction of nozzle, the latter is made of metal and instead of the resilient latch portions, the shank is provided with an external screw thread which engages an internal screw thread around the aperture in the pipe.

A disadvantage encountered with this construction is that the threads tend to bind.

The present invention seeks to obviate one or more of these disadvantages.

Accordingly, the present invention is directed to a steam outlet assembly comprising a tubular portion within which steam passes when the assembly is in use, and a steam nozzle which extends through apertures in the tubular portion which are spaced apart circumferentially therearound, which nozzle is provided with an opening in the tubular portion interior which is in communication with at least one outlet of the nozzle outside the tubular portion, and which nozzle is provided with seal means around the apertures on the outside of the tubular portion.

The seal means comprise at least one sealing portion which has a face which is adjacent to the exterior of the tubular portion and which is shaped to conform thereto.

In one preferred embodiment, such a sealing portion constitutes a head portion of the nozzle from which extends a shank portion, being the portion which extends through the apertures in the tubular portion, and a further such sealing portion on the side of the tubular portion opposite to that where the head portion is located.

Respective O-ring seals are located around the shank portion, between the pipe and the sealing portions, thereby to surround the apertures in the tubular portion.

The end of the shank portion further from the head portion may be externally screw-threaded, and on to this external screw-threading may be engaged a nut which may be tightened to secure the nozzle in position on the tubular portion and to ensure that the sealing portions are urged tightly against the tubular portion.

The tubular portion is circular in cross-section, and the radius of curvature $r_s$ of the said face of each of the sealing portions is given by the following equation:

$$r_s = r_t + d$$

in which $r_t$ is a nominal radius of curvature of the exterior of the tubular portion, and d is the compressed thickness of each O-ring.

An advantage of such a construction of a steam outlet assembly is that the nozzle can be readily replaced at the site of installation.

An example of a steam outlet assembly made in accordance with the present invention is illustrated in the accompanying drawings, in which:

FIG. 1 shows a part sectional view through the assembly with a nozzle part thereof being viewed from one side;

FIGS. 1*a* and 1*b* show respective side views of a tubular portion of the assembly, from opposite sides;

FIGS. 2*a* and 2*b* show respective side views of a nozzle part; viewing the latter in directions which are spaced apart by 90° relative to one another around the axis of the nozzle part;

FIGS. 2*c* and 2*d* show respective opposite ends of the nozzle parts shown in FIGS. 2*a* and 2*b;*

FIGS. 3*a*, 3*b* and 3*c* show a top view and respective side views in respective directions which are at 90° relative to one another, of a sealing portion of the nozzle shown in FIG. 1;

Figure 6:
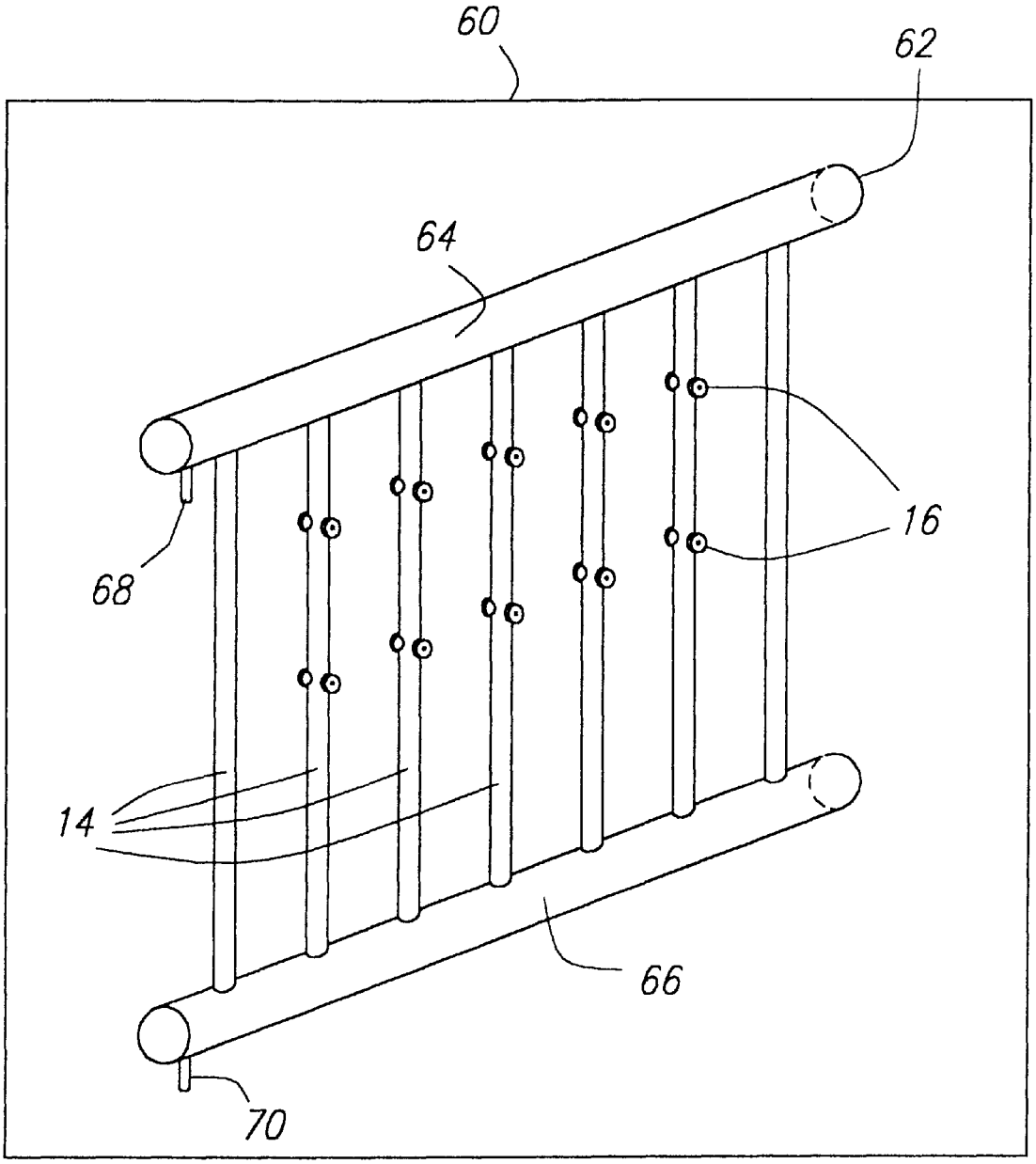
FIG. 6 shows humidifying apparatus which incorporates a multiplicity of assemblies, each as shown in FIGS. 1 to 5.

The assembly 10 shown in FIGS. 1 to 6 comprises a metal tubular portion 12 which is part of a generally upright pipe, such as is shown labelled 14 in FIG. 6, and a moulded plastics nozzle 16 extending through diametrically opposite apertures 18 and 20 through the walls of the tubular portion 12. The nozzle 16 has a head 22 outside the tubular portion 12 adjacent to the aperture 20 therein, and a shank portion 24 which extends through both apertures 18 and 20 so that it projects outwardly of the tubular portion 12 on the opposite side thereof to the head 22. Part of the shank 24 which extends outwardly from the aperture 18 has external screw-threading 26.

The head 22 has a cylindrically curved surface 28 which conforms to the exterior cylindrically curved surface of the tubular portion 12, so that the head 22 constitutes a sealing portion of the nozzle 16. An O-ring 30 is sandwiched between the head 22 and the tubular portion 12 so that it surrounds the shank 24 and the aperture 20 and provides a seal between the head 22 and the tubular portion 12. A further sealing portion 32 having a shape which conforms to the head 22 but which is made as a separate part of the nozzle 16 and which has a through-bore 34 of a diameter slightly greater than the external diameter of the shank 24, is slid thereon with its curved face 36 facing the tubular portion 12, with an O-ring 38 sandwiched between the sealing portion 32 and the tubular portion 12.

Finally, a nut 40 having an internal screw-thread which matches the external screw-thread 26 of the nozzle 16 is rotated on to the screw-threaded portion 26 and tightened until the O-rings 30 and 38 are clamped tightly between the head 22 and the tubular portion 12 on the one hand, and the sealing portion 32 and the tubular portion 12 on the other hand. To prevent distortion of the O-rings 30 and 38 when tightening the nut 40, the two sealing portions 22 and 32 are surrounded by a skirt 41.

The separate sealing portion 32 is provided with two lugs 50 extending inwardly into the central hole 51 and the screw-threaded shank 24 is formed with corresponding key-ways 52 to ensure that the sealing portion 32 is correctly aligned and prevented from rotating as the nut 40 is tightened.

The shank 24 is provided with a transverse through-bore 42 which extends along the axis of the tubular portion 12. It is also provided with an axial through-bore 44 extending right the length of its own axis opening out at both its head end and its screw-threaded end.

The head 22 is provided with flats 45 on opposite sides of the head 22. These are parallel to the through-bore 42 and provide the dual rôle of (a) enabling the head to be grasped readily with a spanner or monkey-wrench and (b) enabling the assembler to ensure that the through-bore 42 is in alignment with the axis of the tubular portion 12.

It will be seen that the radius of curvature $r_s$ of the face 28 of the head 22 and also of the face 36 of the sealing member 32 is given by the equation:

$$r_s=r_t+d$$

in which $r_t$ is a nominal radius of curvature of the exterior of the tubular portion, and d is the compressed thickness of each O-ring. This ensures that a good seal is effected around both apertures 18 and 20, notwithstanding tolerances allowed in the manufacture of the tubular portion 12, the head 22 and the sealing member 32.

When the assembly is in use, steam flows through the interior of the tubular portion 12 in an axial direction therealong. Some of the steam passes straight by the shank 24 on the side thereof, indicated by label 46, and some passes on the side thereof, labelled 48. Some of the steam passes straight through the transverse through-bore 42. Some of the steam however, because of a pressure differential between the inside of the tubular portion 12 and the exterior thereof passes into the transverse through-bore 42 and thence into the axial bore 44 and out from the nozzle 16 in opposite directions outwardly from the tubular portion 12.

Any condensate in the steam within the tubular portion 12 will either pass straight through the spaces on the sides 46 and 48 of the shank 24, or will pass straight through the through-bore 42, or if it should impinge upon the shank itself, will flow around the outside thereof, then leave the shank downstream thereof. Because of the steam flow, it is extremely unlikely that condensate will find its way into the axial bore 44.

The very presence of the shank 24 right the way across the interior of the tubular portion 12 itself causes a throttle effect whereby, in accordance with Bernoulli's principle, the steam will flow more rapidly past the shank 24, then it flows through other parts of the tubular portion 12. This reduces the likelihood still further that any condensate will find its way into the axial bore 44.

In the apparatus shown in FIG. 6, ducting 60 contains a steam header pipe 62 from which extends a feed pipe 64 which is on a slant downwardly from the header pipe 62, and a drain pipe 66, generally parallel to the feed pipe 64, and positioned directly therebelow. The pipes 64 and 66 are provided with respective drains 68 and 70 at their lower ends. A multiplicity of parallel upright pipes 14 extend from the feed pipe 64 to the drain pipe 66. The interiors of all these pipes 14, 62, 64 and 66 are directly or indirectly in communication with one another.

Spaced apart along the length of each of the pipes 14 are a number of nozzles 16. When the apparatus is in use, steam is fed through the header pipe 62 into the feed pipe 64 and thence down the upright pipes 14 to the drain pipe 66. In the process, steam exits from the pipes 14, via the nozzles 16, thereby to humidify the air which passes through the ducting 60.

Numerous variations and modifications of the illustrated assembly will readily occur to the reader of ordinary skill in the art without taking the variation or modification outside the scope of the present invention. For example, the apertures 18 and 20, whilst preferably being diametrically opposite to one another in the tubular portion 12, do not have to be diametrically opposite, so that the shank 24 could, for example, be offset from the central axis of the tubular portion 12.

The bore 44 may, instead of being through-bore, be blind at the screw-threaded end 26 of the shank 24, so that steam may only be ejected through the head end.

Figure 1:
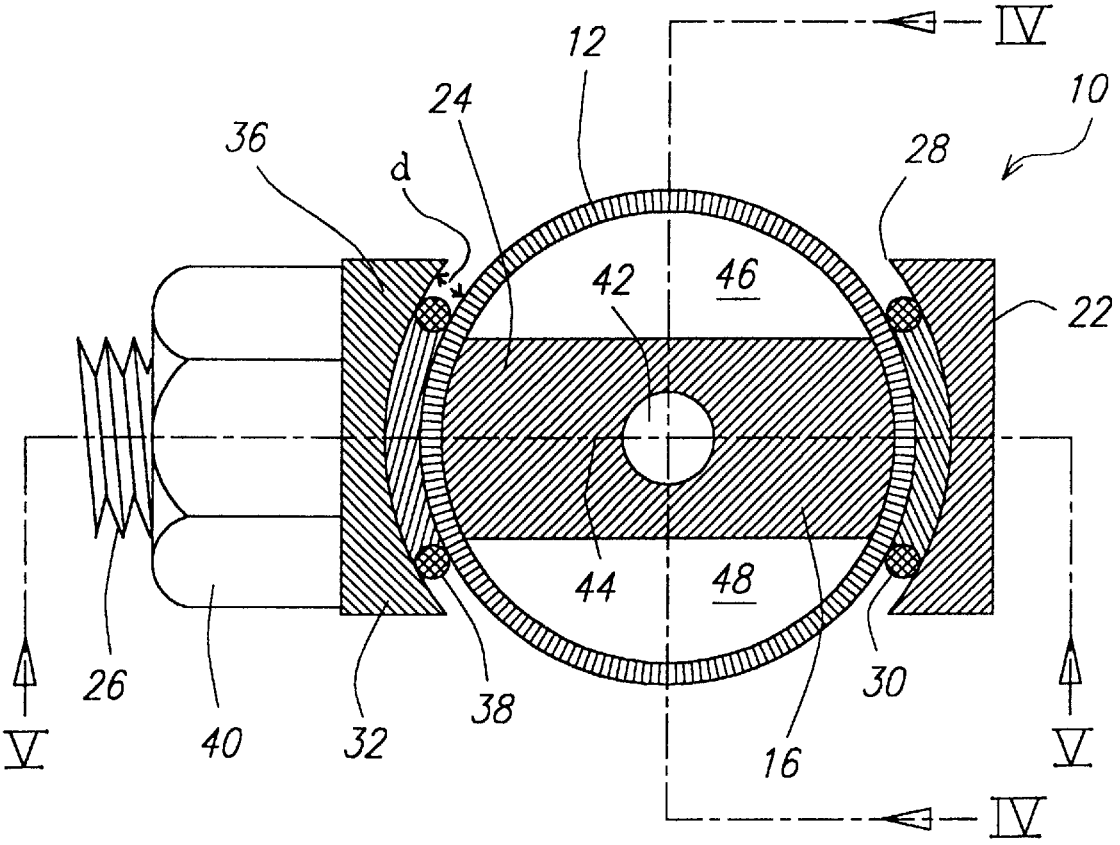
Figure 1A:
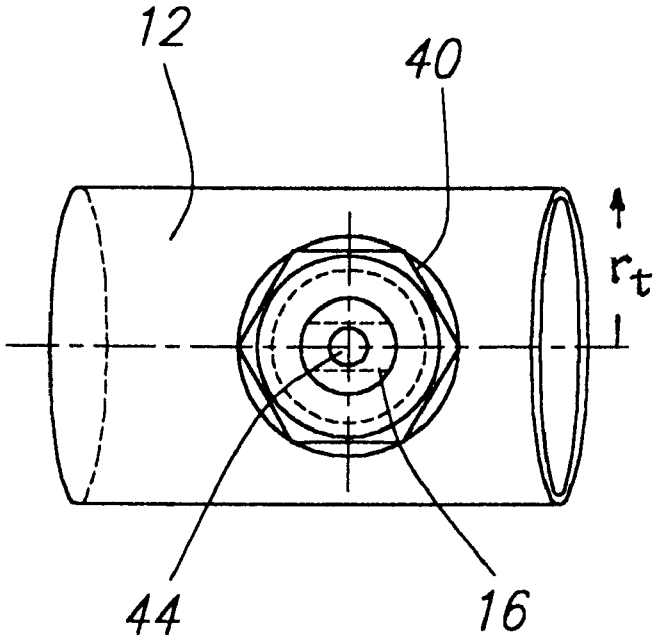
Figure 1B:
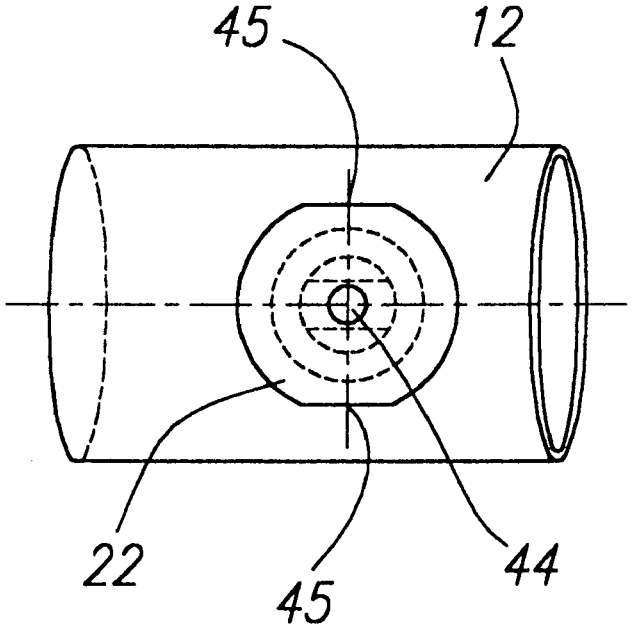
Figure 2B:
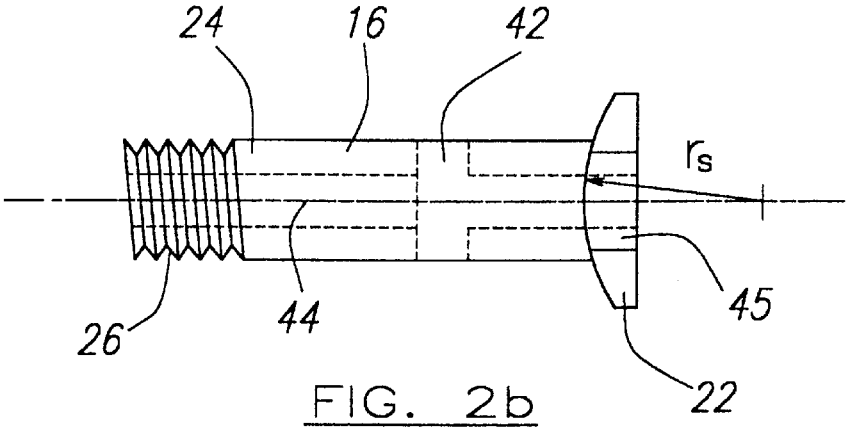
Figure 2A:
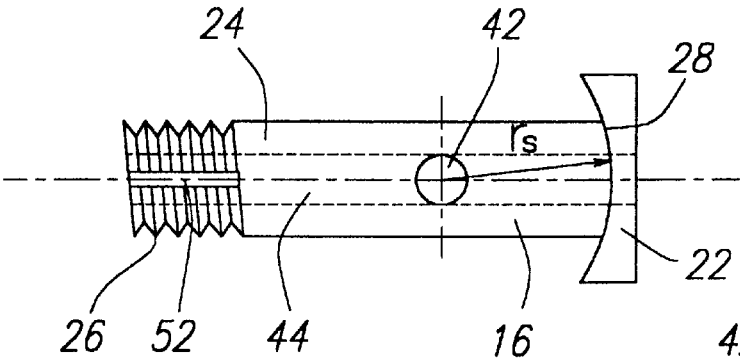
Figure 2D:
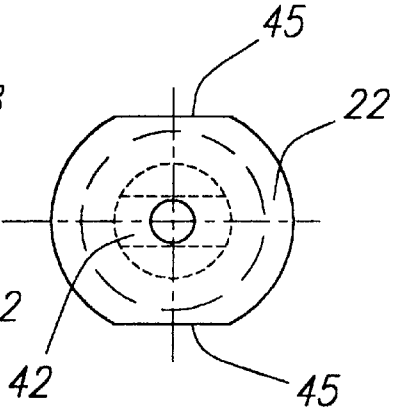
Figure 2C:
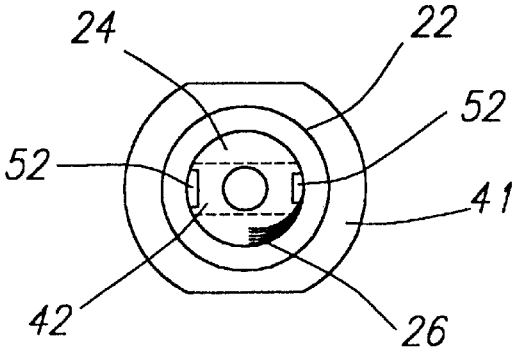
Figure 4:
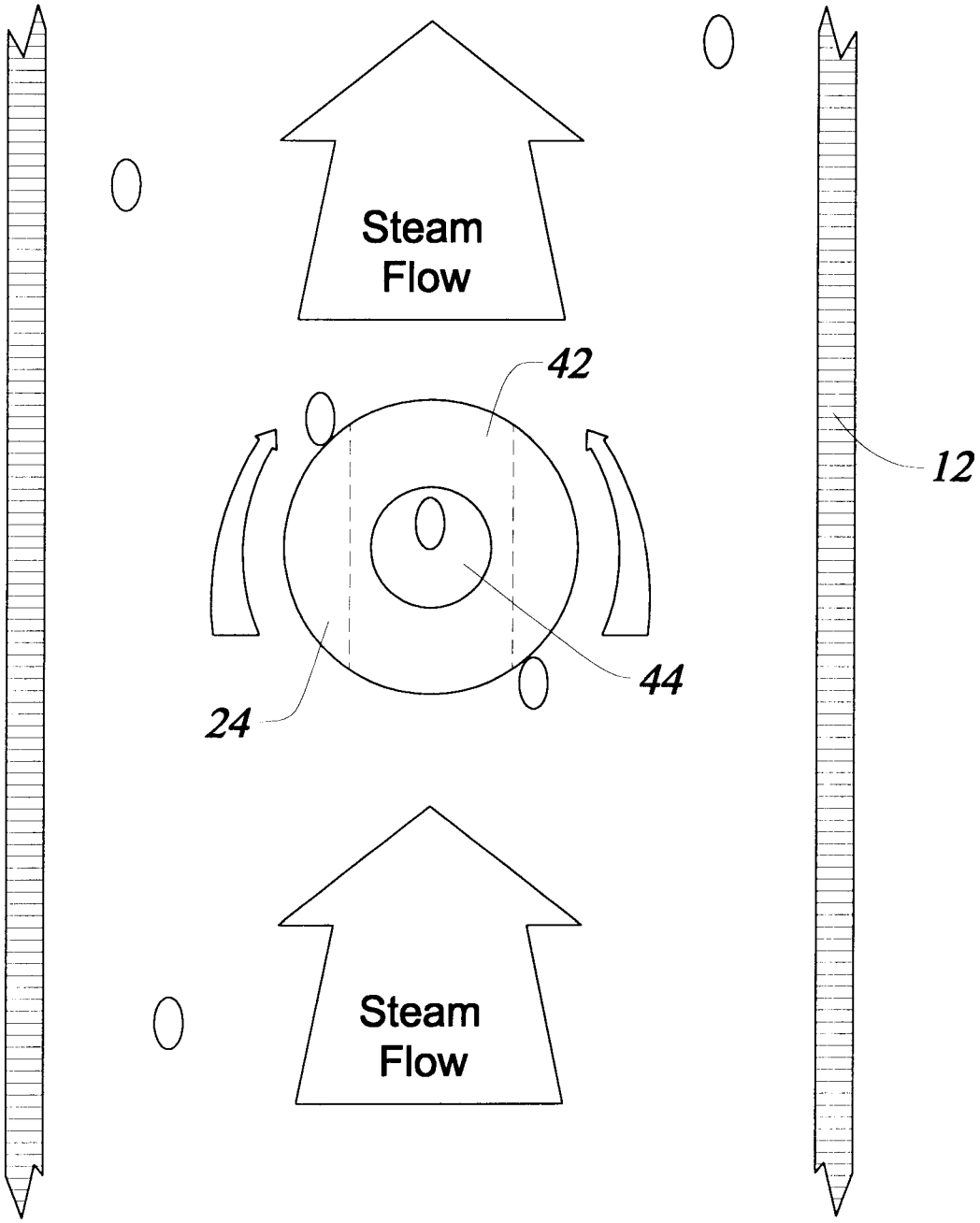
FIG. 4 shows an axial sectional view of the assembly taken in the plane labelled IV—IV in FIG. 1.
Figure 5:
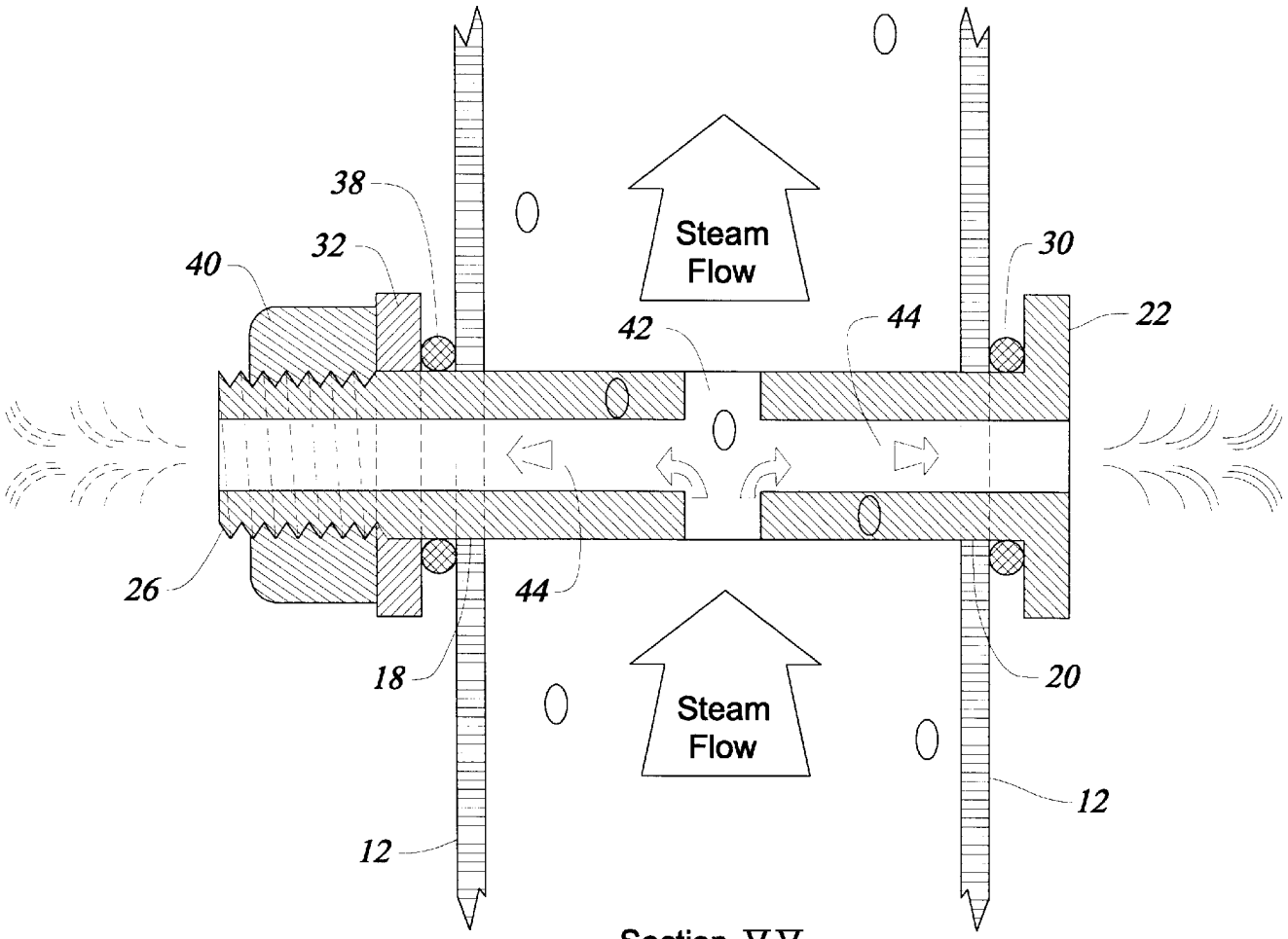
FIG. 5 shows an axial sectional view of the assembly shown in FIG. 1 taken in the plane labelled V—V in FIG. 1.

Instead of the head 22, this end of the nozzle 16 could be constructed in precisely the same way as the screw-threaded end 26 shown in FIG. 1, so that in place of the head 22, the shank 24 could be extended further outwardly, provided with an external screw-threading, and also with a separately made sealing member, like the one labelled 32, and a further nut, like the one labelled 40. One or both ends of the nozzle 16 could in this case be provided with a marker line or groove parallel to the through-bore 42 to enable the latter to be correctly aligned.

I claim:

1. A steam outlet assembly comprising a tubular portion within which steam passes when the assembly is in use, and a steam nozzle which extends through apertures in the tubular portion which are opposite one another, which nozzle is provided with an opening in the tubular portion interior which is in communication with at least one outlet of the nozzle outside the tubular portion, and which nozzle is provided with sealing portions around said apertures on the outside of the tubular portion, which sealing portions have respective faces which are each adjacent to the exterior of the tubular portion and which are each shaped to conform thereto, in which O-ring seals are located around the nozzle between the tubular portion and the sealing portion, thereby to sure said apertures in the tubular portion respectively, and in which the tubular portion is circular in cross-section, and the said faces have a radius of curvature $r_s$, which is given by the following equation:

$$r_s=r_t+d$$

in which $r_t$ is the radius of curvature of the exterior of the tubular portion, and d is the compressed thickness of each O-ring.

2. A steam outlet assembly according to claim 1 in which the nozzle has a head portion constituting one of the said sealing portions, and a shank portion which extends from the head portion of the nozzle through the said apertures in the tubular portion.

3. A steam outlet assembly according to claim 2, in which a part of the shank portion further from the head portion is externally screw-threaded.

4. A steam outlet assembly according to claim 3, in which a nut is engaged on the screw-threading, which nut is tightened to secure the nozzle in position on the tubular portion and to ensure that the sealing portions are urged tightly against the O-ring seals.

* * * * *